US006176366B1

(12) United States Patent
Meyer et al.

(10) Patent No.: US 6,176,366 B1
(45) Date of Patent: Jan. 23, 2001

(54) APPARATUS FOR THE SUPPLY OF BAGS

(75) Inventors: Erich Meyer, Schwaebisch Hall; Klaus Griessmayr, Rosengarten; Dietmar Schmetzer, Michelbach/B., all of (DE)

(73) Assignee: Optima-Maschinenfabrik Dr. Buhler GmbH & Co., Schwaebisch Hall (DE)

( * ) Notice: Under 35 U.S.C. 154(b), the term of this patent shall be extended for 0 days.

(21) Appl. No.: 09/318,084

(22) Filed: May 25, 1999

(30) Foreign Application Priority Data

May 28, 1998 (DE) ..... 198 23 875

(51) Int. Cl.[7] ..... B65G 15/42

(52) U.S. Cl. ..... 198/803.14; 198/817; 53/459; 53/468; 53/384.1

(58) Field of Search ..... 198/817, 688.1, 198/867.11, 803.14; 53/459, 468, 381.1, 381.5, 384.1–386.1

(56) References Cited

U.S. PATENT DOCUMENTS

| | | | | |
|---|---|---|---|---|
| 3,044,233 | * | 7/1962 | Altman . | |
| 3,391,519 | | 7/1968 | Keenan, Jr. et al. | 53/189 |
| 4,047,362 | | 9/1977 | Lister et al. | 53/189 |
| 4,583,349 | | 4/1986 | Kramming | 53/459 |
| 4,741,525 | * | 5/1988 | Ebmeyer et al. | 198/817 |
| 4,805,381 | | 2/1989 | Hannon | 53/459 |
| 4,923,064 | | 5/1990 | Hannon | 206/554 |
| 5,301,796 | * | 4/1994 | Rautio | 198/817 |

FOREIGN PATENT DOCUMENTS

| | | |
|---|---|---|
| 48197 79 | 1/1980 | (AU) . |
| 32 48 628 A1 | 7/1984 | (DE) . |
| 41 37 246 A1 | 7/1992 | (DE) . |
| 42 18 033 A1 | 12/1993 | (DE) . |
| 42 31 103 C2 | 3/1994 | (DE) . |
| 195 11 951 A1 | 10/1996 | (DE) . |
| 195 21 852 A1 | 12/1996 | (DE) . |
| 196 12 708 A1 | 10/1997 | (DE) . |
| A1 0 005 044 | 10/1979 | (EP) . |
| 21 141 921 | 1/1973 | (FR) . |

OTHER PUBLICATIONS

German Search Report dated Sep. 13, 1999 for 99109913.6–2308.

* cited by examiner

*Primary Examiner*—Joseph E. Valenza
(74) *Attorney, Agent, or Firm*—Quarles & Brady LLP

(57) ABSTRACT

An apparatus for the supply of bags formed into stacks to a point where in each case the top bag of the stack is to be opened, contains two parallel conveyors, e.g. in the form of revolving chains, which are synchronously driven. The stacks are held together by two holding members. The holding members are so inserted with a widened foot in the holders of the conveyor that they can be slid out of the holders again through a stop member. These holders have a small mutual spacing, so that the stacks of bags can be juxtaposed on the apparatus with a small reciprocal spacing.

16 Claims, 2 Drawing Sheets

APPARATUS FOR THE SUPPLY OF BAGS

Figure 1:
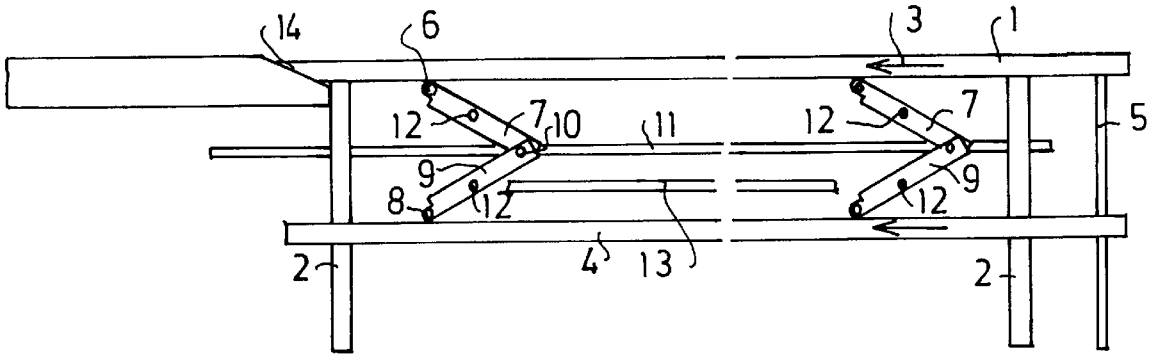

The invention is directed at an apparatus with which bags are supplied to a magazine where the opening and filling thereof take place. Such an apparatus has already been proposed, in which two roller chains carry the stacks of bags from the loading point to the opening point thereof. The two chains are driven by means of a common shaft. On the side where the bags are open the chain has pins by means of which the bags are stripped with the projecting flap thereof. Holes are provided in the link plate. The groups of pins are uniformly distributed round the chain circumference. The spacing of the individual pin groups is a function of the widest bag and the chain length. The second, parallel-running chain conveys the bags to the opposite end thereof, i.e. the floor. Here again use is made of an angular link plate chain. To prevent sliding of the bags during conveying, driving pins are screwed into bearing blocks between the stacks.

The problem of the invention is to provide an apparatus for the supply of bags, which has a greater storage volume for the same chain size.

To solve this problem the invention proposes an apparatus having the features of claim 1. Further developments of the invention form the subject matter of the dependent claims, whose wording, like that of the abstract are, by reference, made into part of the content of the description.

Through the provision of a plurality of holders, the holding members can be fitted to a very large number of points on the revolving or rotating conveyor, so that the conveyor length is better utilized and consequently more stacks of bags can be housed.

According to a further development of the invention the holding members are detachably received in the holders. Thus, on changing the bag size, the holding members can be adapted to the new bags by using them in corresponding holders.

The invention in particular proposes that the holders are arranged in a grid spacing arrangement smaller than the dimensions of the bags measured in the conveying direction and which is in particular small compared with said dimensions. If the conveyor is constituted by a revolving chain, the grid spacing arrangement can e.g. correspond to the length of a single chain link. This makes it possible to reduce the spacing between successive stacks of bags to the size of said grid spacing. According to a further development of the invention the holders are constructed in such a way that the holding members can be released therefrom by running up onto a stop member. This makes it possible to remove from the apparatus a bag stack or the remainder of a bag stack if the top bag cannot be opened.

According to a further development of the invention the holding members are constructed in pin-like manner and in particular as small tubes, i.e. hollow. As a result the holding members are very light and due to their limited weight and their not very great stability they give rise to a reduced injury risk, so that only simpler protective measures are needed for the apparatus. This more particularly applies if the holding members can be released by simply sliding out of the holders.

According to a further development of the invention the holding members secure the bags in that they are slipped or inverted over the holding members using holes.

It can in particular be provided that the holding members have a head shaped like an inverted frustum. This on the one hand prevents an undesired release of a bag, but without preventing its desired release for filling purposes.

According to the invention the holding members have a widened foot with which they can be fixed in the holders. The holders can engage on the shank of the holding member, whilst the widened foot is inserted under a part of the holder and can only be removed in a specific direction.

According to a further development of the invention the holding members can be inserted in the holders in a direction which slopes or is at right angles to the conveying direction. They can be slid out again in the same or the opposite direction.

According to the invention a second conveyor can be positioned parallel to the first conveyor, which can e.g. be constructed as a revolving chain, a revolving belt, a revolving strap or the like.

In particular, the second conveyor can be driven synchronously to the first.

According to the invention the second conveyor can also have receptacles for holding members and in particular the same receptacles for the same holding members. They are consequently used in holders in such a way that they enclose the stacks of bags pairwise between them. Thus, also at high conveying speeds a lateral sliding of the bags is prevented.

The bags can e.g. be arranged in such a way that they are held on the first conveyor and roughly in the centre of their length rest on the second conveyor. The remainder of the bag can then hang down over the second conveyor. According to the invention, in the case of larger bags the apparatus can have a bearing rail parallel to the conveyor or conveyors, so that the bags are simply supported.

According to the invention, for adapting to different bag sizes, the spacing between the first and second conveyors can be adjustable, as can the spacing between the first conveyor and the bearing rail. It can in particular be provided that on adjusting the spacing between the two conveyors there is a simultaneous modification to the spacing with respect to the bearing rails, so that they are e.g. always located centrally between the conveyors.

According to the invention, considered in the conveying direction behind the point where the bags are opened and removed, a sliding out device is provided for those bags or bag stacks, which are faulty or behave in a faulty manner. It is also possible to slide out here the then no longer required holding members. This sliding out device can in particular be a sloping stop member, in which the sliding out action is achieved in that the conveyor moves the holding members against the sloping surface.

Further features, details and advantages of the invention can be gathered from the following description of a preferred embodiment and the attached drawings, wherein show:

FIG. 1 A diagrammatic plan view on the bag supply apparatus proposed by the invention.

Figure 2:
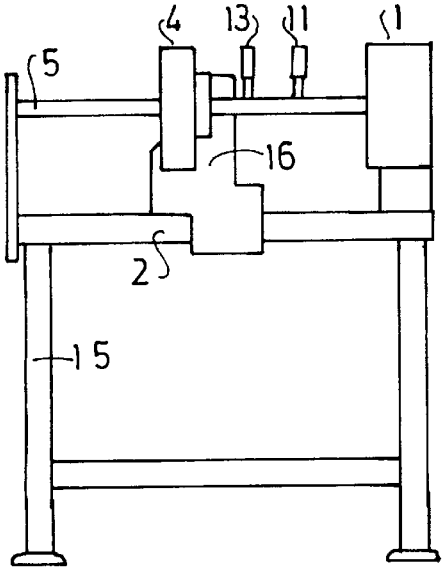

FIG. 2 A front view of the apparatus from the right in FIG. 1.

Figure 3:
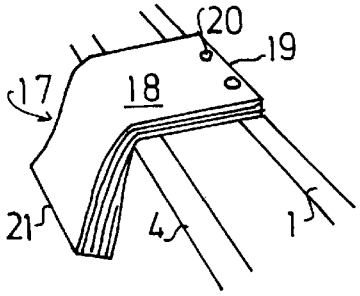

FIG. 3 Diagrammatically the arrangement of bags on the two conveyors.

Figure 4:
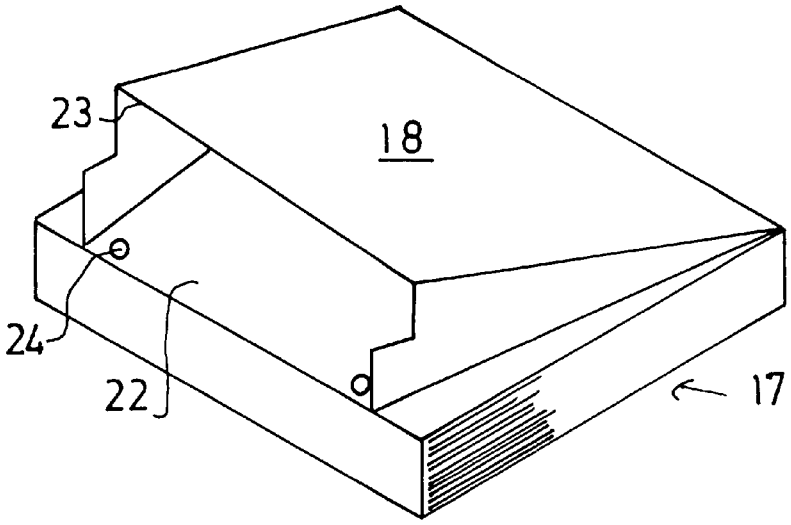

FIG. 4 Diagrammatically a stack of bags with an opened bag on the top.

Figure 5:
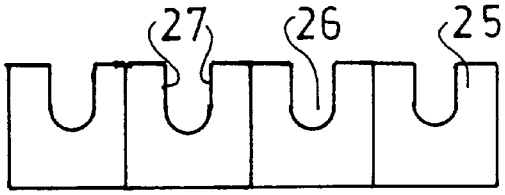

FIG. 5 A plan view of part of a conveyor with four holders.

Figure 6:
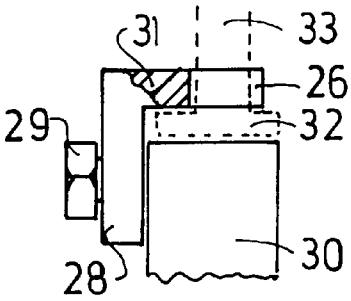

FIG. 6 A part sectional side view of a holder.

Figure 7:
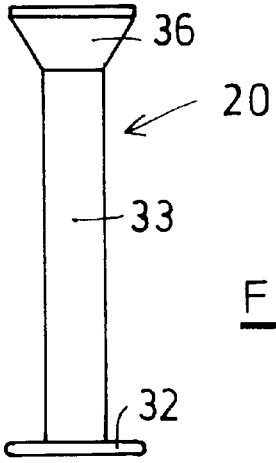

FIG. 7 A side view of a holder.

FIG. 1 shows in greatly simplified form a shortened plan view of an apparatus with which bags can be supplied from right to left to a point where the top bag of a stack can be opened. The apparatus contains a first revolving or rotating conveyor 1, e.g. a revolving chain or belt, whereof the upper strand is visible. The chain is guided by means of several support wheels and two guide wheels. These wheels are mounted on a common web, which is positioned below the conveyor 1 and is not shown in the drawing. The web is fixed to two beams 2, which run at right angles to the conveying direction and is represented by the arrow 3, as well as parallel to the floor on which the apparatus is set up.

Spaced with respect to the first conveyor 1, on the beams 2 is placed a second conveyor 4, which has a similar construction to the first conveyor 1. It also contains a revolving chain or a belt. The chain is placed round two guide wheels and is supported along the length thereof and a web is also provided for this purpose. This web can be moved along the beams 2. The guide wheel positioned at the right-hand end of the conveyor 1 in FIG. 1 is connected by means of a shaft 5 to the corresponding guide wheel of the front conveyor 4, which leads to a synchronous movement of the two conveyors 1, 4.

On the web of the first conveyor 1 are provided two pins 6, to which are articulated two parallel levers 7. A similar pin 8 is fitted to the side of the web of the second conveyor 4 facing the first conveyor 1. Once again to said pin 8 are articulated two parallel levers 9, which are pivotably connected in the vicinity of their ends to the two first levers 7. All the levers 7, 9 are of equal length. If the articulation point 10 of the two pairs of levers 7, 9 is displaced to the left or right, there is a change in the spacing between the conveyors 1, 4, which remain parallel to one another.

To the articulation point 10 of the two lever pairs 7, 9 is connected a rail 11, which is only diagrammatically represented in FIG. 1. The rail 11 runs above the levers 7, 9 and above the beams 2. Its top is in a single plane with the top of the two conveyors 1, 4. Roughly in the centre of the longitudinal extension of the two lever pairs 7, 9 is in each case provided a further pin 12. On said pins 12 can be mounted further rails 13 which, on modifying the spacing between the two conveyors 1, 4, also modify the reciprocal spacing thereof, but remain parallel to the conveyors 1, 4. Also in the case of rail 13, the top is in one plane with the top of the conveyors 1, 4.

In the area of the left-hand end of the first conveyor 1 is formed a stop member 14, which is under an angle of approximately 30° with respect to the longitudinal direction of the conveyor 1 and therefore runs opposite the latter. This stop member 14 is located behind the point where the bags are opened.

FIG. 2 is a front view of the apparatus of FIG. 1 from the right and on a larger scale. The conveyor 1, which is represented in simplified form as a revolving belt, is firmly positioned in the vicinity of one end of the beam 2, which is located on a frame 15. The second conveyor 4 is displaceably secured on the beams 2 with the aid of a holder 16.

FIG. 2 shows two bearing rails 13, 11, which are positioned between the top of the first conveyor 1 and the second conveyor 4.

FIG. 3 shows in simplified, perspective form how a stack 17 of bags 18 is placed on the rear and front conveyors 1, 4 so as to permit conveying with the aid of the apparatus. In the vicinity of their open ends 19, the bags 18 are fixed with holding members 20 to the conveyor 1. They rest on the second conveyor 4, their ends 21 hanging down. In the space between the first and second conveyors 1, 4 the bags can be supported by bearing rails 11, 13. In this arrangement the stacks are supplied to the point where the bags are opened.

FIG. 4 shows a bag stack 17, in which the top bag 18 is opened. In the vicinity of its open end the bag 18 has a flap 22 which projects with respect to the edge 23. In said flap are punched two holes 24 with which the bags 18 can be lined up on the holding members 20. For opening the bag, e.g. using a suction cup or some other suction device, action takes place on the upper wall of the bag and the latter is moved upwards. The bag content can then be introduced into the resulting opening.

FIG. 5 shows on a larger scale a plan view of part of a conveyor, namely four successive holders 25 for the holding members 20 arranged in the longitudinal direction of the conveyor. Each holder 25 is formed by an angular member, in whose horizontal legs is provided a U-shaped recess 26. The centre axis between the two parallel lateral edges 27 of the recess 26 runs at right angles to the conveying direction of the conveyor. The vertical leg 28 of the holder is e.g. screwed with the aid of a screw 29 to the chain link 30, as can be seen in FIG. 6. In FIG. 6 the conveying direction is perpendicular to the plane of the paper. To the right in FIG. 6 is shown the rear side of the conveyor 1, i.e. also to the right in FIG. 2. Between the outside of the chain link 30 and the inside of the horizontal leg 31 is provided a gap, into which fits the foot 32 of the holding member 20, as is shown in broken line form in FIG. 6. The shank 33 of the holding member is embraced by the lateral edges 27 of the recesses 26. The holding member 20 can be removed to the right in FIG. 6 and upwards in FIG. 5 from the holder 25 and can be inserted therein in the reverse direction.

FIG. 7 once again shows on a larger scale a holding member 20, such as can be advantageously used in the invention. The holder member 20 is in the form of a small cylindrical tube 33 with a discoidal foot 32 and a head 36 in the form of an inverted frustum. The foot 32 can be screwed into the lower end of the shank 33. The head 36 can be clamped to the upper end of the shank 33. Whereas the diameter of the shank 33 roughly corresponds to the diameter of the holes 24, the diameter of the head 36 is somewhat larger, which prevents an unintentional release of bags from a stack. However, if the bag material is somewhat flexible, the bag can still be released from the stack. Even in the case of an inflexible material, the hole may possibly be torn open.

The apparatus proposed by the invention functions in the following way. The bags are assembled in stack form and are held together with the aid of holding members 20. The two holding members are then slid into the recesses 26 from the right-hand, rear side in FIG. 3, i.e. in FIG. 5 from above and in FIG. 6 from the right. The bags are oriented in the manner shown in FIG. 3. The next stack can then be fixed directly alongside the preceding stack, because the spacing of the recesses 26 is relatively small. For example, the spacing of two recesses 26 corresponds to the length of a chain link in the conveying direction, e.g. approximately 2.5 cm. Thus, the length of the conveyors 1, 4 can be utilized with only small gaps between the bag stacks. The apparatus is then operated in such a way that the bag stacks are brought to the point where they are opened. If it is found that a bag will not open, the associated bag stack can be discharged from the apparatus so as to permit the latter to be easily conveyed on. Then the shank of the holding member 20 in the conveying direction engages on the stop member 14, where it is then moved outwards until the shank 33 is disengaged from the holder 25. The holding members 20 are also slid out in the same way when all the bags of a stack have been processed.

What is claimed is:

1. Apparatus for the supply of bags to a station for opening said bags, having a revolving conveyor, a plurality of holders, which are fitted to the conveyor and are constructed for in each case receiving one holding member, in which several bags can be fixed to in each case two holding members in the vicinity of their open ends for the formation of a bag stack.

2. Apparatus according to claim 1, wherein the holding members are detachably received in the holders.

3. Apparatus according to claim 1, wherein the holders are arranged with a grid spacing arrangement smaller than the dimensions of the bags measured in the conveying direction of the conveyor and is preferably small compared with said dimensions.

4. Apparatus according to claim 1, wherein the holders are constructed in such a way that the holding members can be released therefrom from running up against a stop member.

5. Apparatus according to claim 1, wherein the holding members have a pin-like construction.

6. Apparatus according to claim 1, wherein the bags have holes with which they can be slipped onto the holding members.

7. Apparatus according to claim 1, wherein the holding members have an inverted frustum-shaped head.

8. Apparatus according to claim 1, wherein the holding members have a widened foot with which they can be fixed in the holders.

9. Apparatus according to claim 1, wherein the holding members are inserted in the holders at right angles to the conveying direction.

10. Apparatus according to claim 1, having a second conveyor arranged parallel to the first conveyor.

11. Apparatus according to claim 10, wherein the two conveyors are driven synchronously.

12. Apparatus according to claim 10, wherein the second conveyor has receptacles for the holding members.

13. Apparatus according to claim 1, having at least one bearing rail parallel to the conveyor.

14. Apparatus according to claim 10, wherein the distance between the first conveyor and the bearing rail can be adjusted.

15. Apparatus according to claim 10, wherein the distance between the first conveyor and the second conveyor can be adjusted.

16. Apparatus according to claim 1, having a sliding out device for sliding out the holding members, optionally together with the bags.

* * * * *